US007083409B2

(12) United States Patent
Kuelbs et al.

(10) Patent No.: US 7,083,409 B2
(45) Date of Patent: Aug. 1, 2006

(54) OIL BURNING LAMP

(75) Inventors: Gregory G. Kuelbs, Westlake, TX (US); Kenneth M. Ward, Azle, TX (US)

(73) Assignee: World Factory, Inc., Coppell, TX (US)

( * ) Notice: Subject to any disclaimer, the term of this patent is extended or adjusted under 35 U.S.C. 154(b) by 0 days.

(21) Appl. No.: 10/211,055

(22) Filed: Aug. 1, 2002

(65) Prior Publication Data

US 2003/0104331 A1 Jun. 5, 2003

Related U.S. Application Data

(60) Provisional application No. 60/311,736, filed on Aug. 10, 2001.

(51) Int. Cl.
*F23D 3/18* (2006.01)

(52) U.S. Cl. ..... 431/321; 431/323; 431/310; 431/304

(58) Field of Classification Search ..... 431/321, 431/323, 310, 304, 305, 324
See application file for complete search history.

(56) References Cited

U.S. PATENT DOCUMENTS

| | | | | | |
|---|---|---|---|---|---|
| 14,016 | A | * | 1/1856 | Dow | 101/277 |
| 708,368 | A | * | 9/1902 | Lehmann | 431/321 |
| 1,681,139 | A | * | 8/1928 | Spear | 431/323 |
| 1,681,140 | A | * | 8/1928 | Spear | 431/323 |

* cited by examiner

*Primary Examiner*—Alfred Basichas
(74) *Attorney, Agent, or Firm*—James E. Walton

(57) ABSTRACT

An oil burning lamp has a fuel reservoir, a fuel expansion chamber releasably and sealingly coupled to the fuel reservoir, a burner assembly coupled to the fuel expansion chamber, and an adjustable wick. If the fuel in the fuel reservoir undergoes thermal expansion, it flows into the fuel expansion chamber, thereby preventing fuel leaks and spills. In the preferred embodiment, the burner assembly is permanently coupled to the fuel expansion chamber, thereby preventing users from refueling the lamp while the lamp is burning. The fuel expansion chamber also serves as an overflow fuel chamber, so that if the lamp is inadvertently knocked over, the fuel will flow into the fuel expansion chamber, not out of the lamp.

19 Claims, 6 Drawing Sheets

OIL BURNING LAMP

This application claims the benefit of U.S. Provisional Application No. 60/311,736, filed 10 Aug. 2001, titled "Oil Burning Lamp."

BACKGROUND

1. Field of the Invention

The present invention relates to oil burning lamps.

2. Description of Related Art

Oil burning lamps have been around for many years. However, the recent popularity in outdoor lighting has created a renewed interest in oil burning lamps and lanterns. Some of these lamps are designed as stand-alone light sources, and some are designed to be placed in decorative lanterns where the light can be magnified and/or used to create a certain ambiance.

These oil burning lamps typically have a reservoir portion which holds the oil or fuel, and a wick that extends out from the reservoir for lighting and burning. The reservoir portion usually includes an inlet port through which the reservoir can be refilled with fuel. In addition, some lamps include a wick advancement mechanism.

One problem associated with oil burning lamps when used outdoors in warm temperatures or in areas with fluctuating temperatures is that a buildup of heat, resulting from exposure of the lamp or its oil reservoir to sunlight or fluctuating temperatures, can cause fuel to expand. Expansion of the fuel can lead to messy leaks and unexpected overflows. A user can fill a lamp with oil in the relatively cooler part of the day, leave the lamp unattended in an area exposed to rising ambient temperatures or to sunlight, and return to find that the oil has overflowed the reservoir.

Another problem associated with oil burning lamps, particularly those lamps with fuel inlet ports located on the top of the reservoir portion, is that users occasionally attempt to refill the reservoir with fuel while the lamp is burning. Refilling lamps with fuel while they are burning presents obvious dangers, including fuel spills and injury to the user and others from fires and explosions.

Yet another problem associated with some oil burning lamps is that if they are inadvertently knocked over, the fuel can spill, creating the potential for a fire.

Thus, although oil burning lamps have been around for many years, they still pose several potential problems.

SUMMARY OF THE INVENTION

There is a need for an oil burning lamp that can safely accommodate thermal expansion of the fuel. In addition, there is a need for an oil burning lamp that cannot be refueled while the lamp is burning. Furthermore, there is a need for an oil burning lamp that will prevent fuel from spilling if the lamp is inadvertently knocked over.

Therefore, it is an object of the present invention to provide an oil burning lamp that can safely accommodate thermal expansion of the fuel, that cannot be refueled while the lamp is burning, and that will prevent fuel from spilling if the lamp is knocked over.

The above objects are achieved by providing an oil burning lamp having a fuel reservoir, a fuel expansion chamber releasably and sealingly coupled to the fuel reservoir, a burner assembly coupled to the fuel expansion chamber, and an adjustable wick. If the fuel in the fuel reservoir undergoes thermal expansion, it flows into the fuel expansion chamber and allows for flow back into the main reservoir chamber, thereby preventing fuel leaks and spills. In the preferred embodiment, the burner assembly is permanently coupled to the fuel expansion chamber, thereby preventing users from refueling the lamp while the lamp is burning. The fuel expansion chamber also serves as an overflow fuel chamber, so that if the lamp is inadvertently knocked over, the fuel will flow into the fuel expansion chamber, not out of the lamp.

The present invention provides significant advantages. Because fuel undergoing thermal expansion flows into the fuel expansion chamber, it does not leak or spill. This greatly reduces the chance of fire, injury to the user, and damage to the lamp and other property. In addition, because the lamp cannot be refilled with fuel while the lamp is burning, the chance of fire, injury to the user, and damage to the lamp and other property is greatly reduced. Furthermore, because the fuel expansion chamber also serves as an overflow fuel chamber, if the lamp is inadvertently knocked over, the fuel will flow into the fuel expansion chamber, not out of the lamp where it can create a dangerous situation.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

Figure 1:
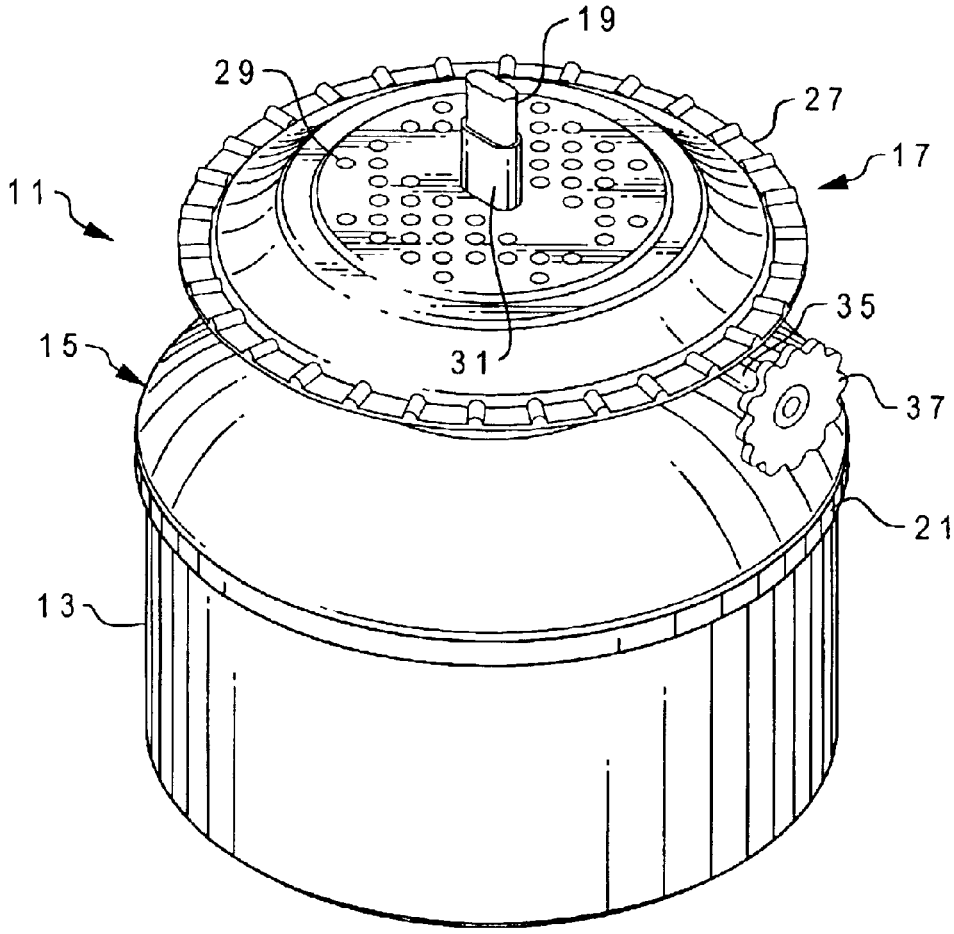
FIG. 1 is a perspective view of an oil burning lamp according to the present invention.
Figure 2:
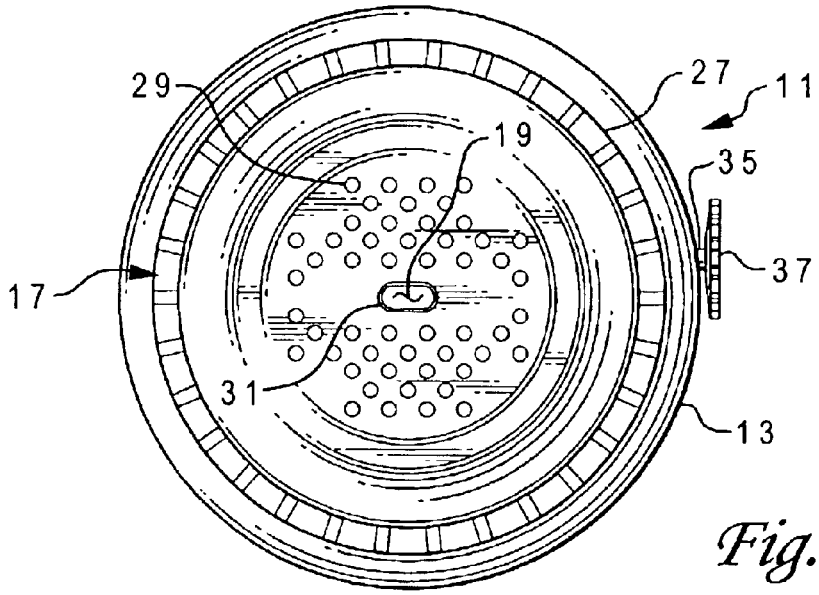
FIG. 2 is a top view of the oil burning lamp of FIG. 1.
Figure 3:
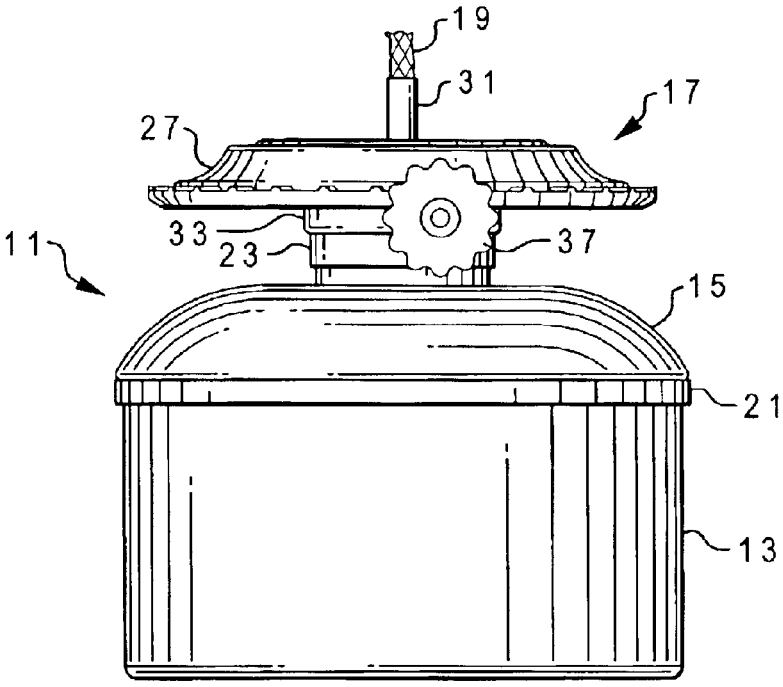
FIG. 3 is a right side view of the oil burning lamp of FIG. 1.
Figure 4:
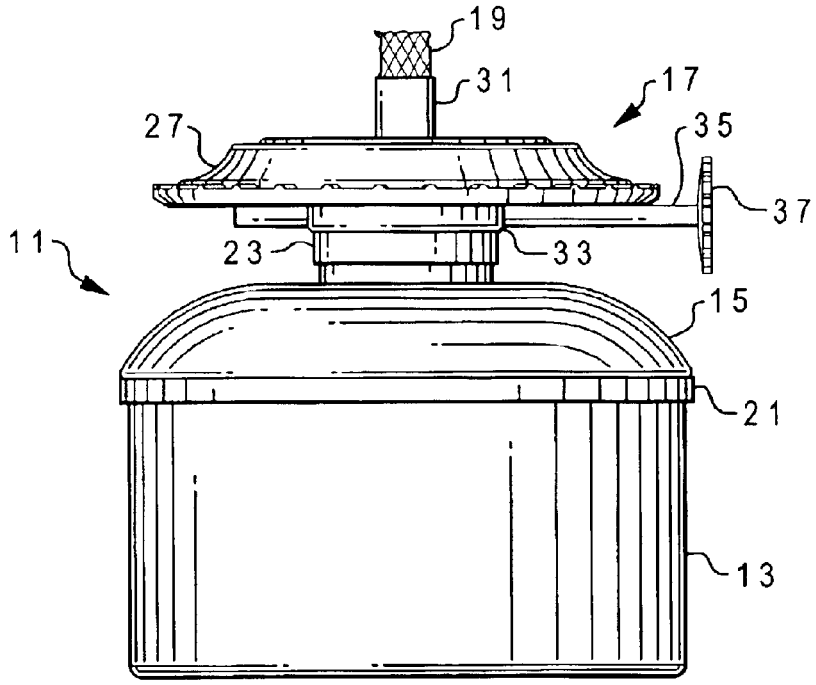
FIG. 4 is a front view of the oil burning lamp of FIG. 1.
Figure 5:
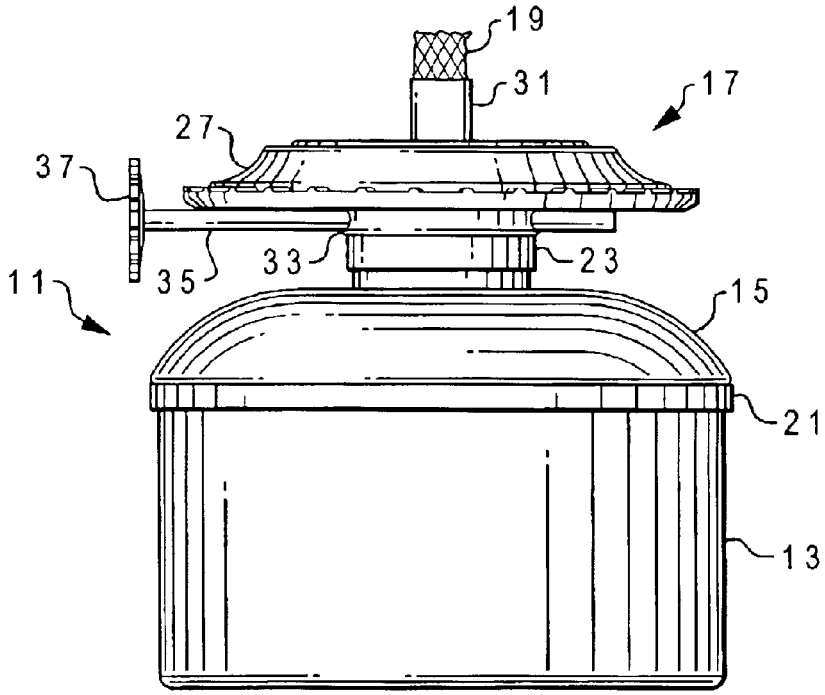
FIG. 5 is a rear view of the oil burning lamp of FIG. 1.
Figure 6:
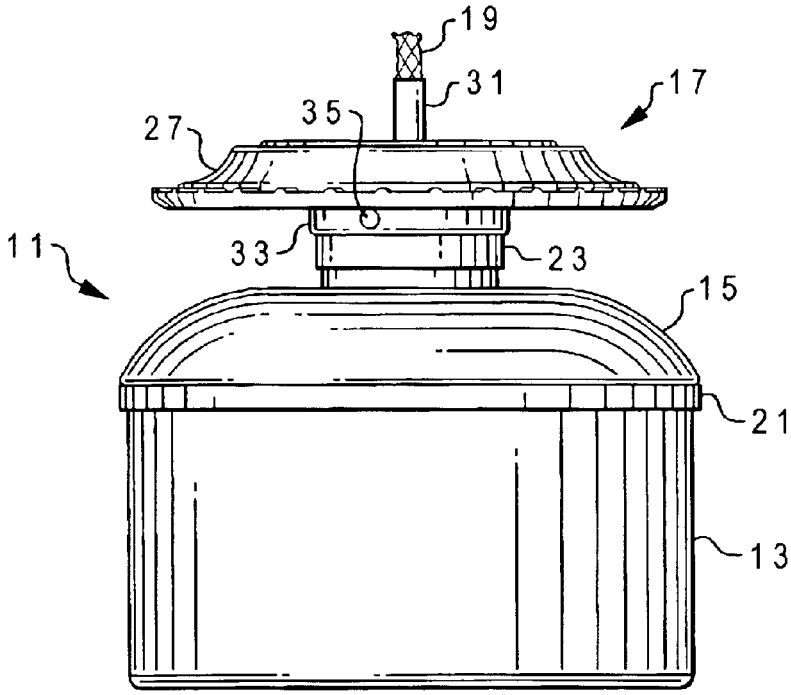
FIG. 6 is a left side view of the oil burning lamp of FIG. 1;.
Figure 7:
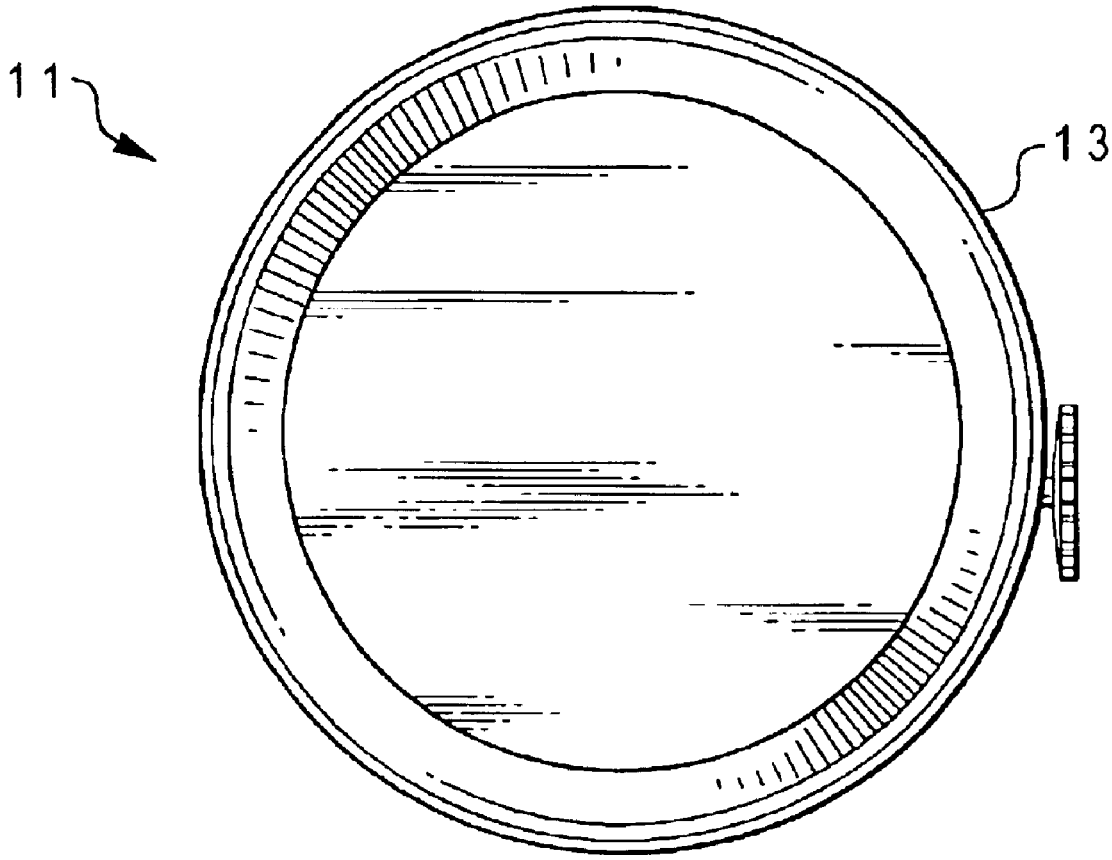
FIG. 7 bottom view of the oil burning lamp of FIG. 1.

Referring to FIGS. 1–7 in the drawings, the preferred embodiment of an oil burning lamp 11 according to the present invention is illustrated. Lamp 11 includes a fuel reservoir 13, a fuel expansion chamber 15 releasably coupled to fuel reservoir 13, a burner assembly 17 coupled to fuel expansion chamber 15, and a wick member 19. Fuel, such as oil, kerosene, or any other suitable fuel (not shown) is stored in fuel reservoir 13. Wick member 19 is disposed in fuel reservoir 13 and extends upward through fuel expansion chamber 15 and burner assembly 17. Wick member 19 is a conventional wick member made of a textile material or any well known material. Wick member 19 absorbs, or wicks, the fuel from fuel reservoir 13, such that the top portion of wick member 19, which extends out from burner assembly 17, can be ignited or lit with a flame source, such as a match or lighter (not shown), and remain burning to provide light to the area surrounding lamp 11.

Fuel reservoir 13 may include a lip 21 to provide aesthetic appeal and structural stiffness to fuel reservoir. Although fuel reservoir 13 is shown having a cylindrical shape, it should be understood that fuel reservoir 13 may have any of a wide variety of shapes and designs, and may be of various heights and dimensions, depending upon the application in which lamp 11 is used and the desired fuel capacity of fuel reservoir 13.

Figure 8:
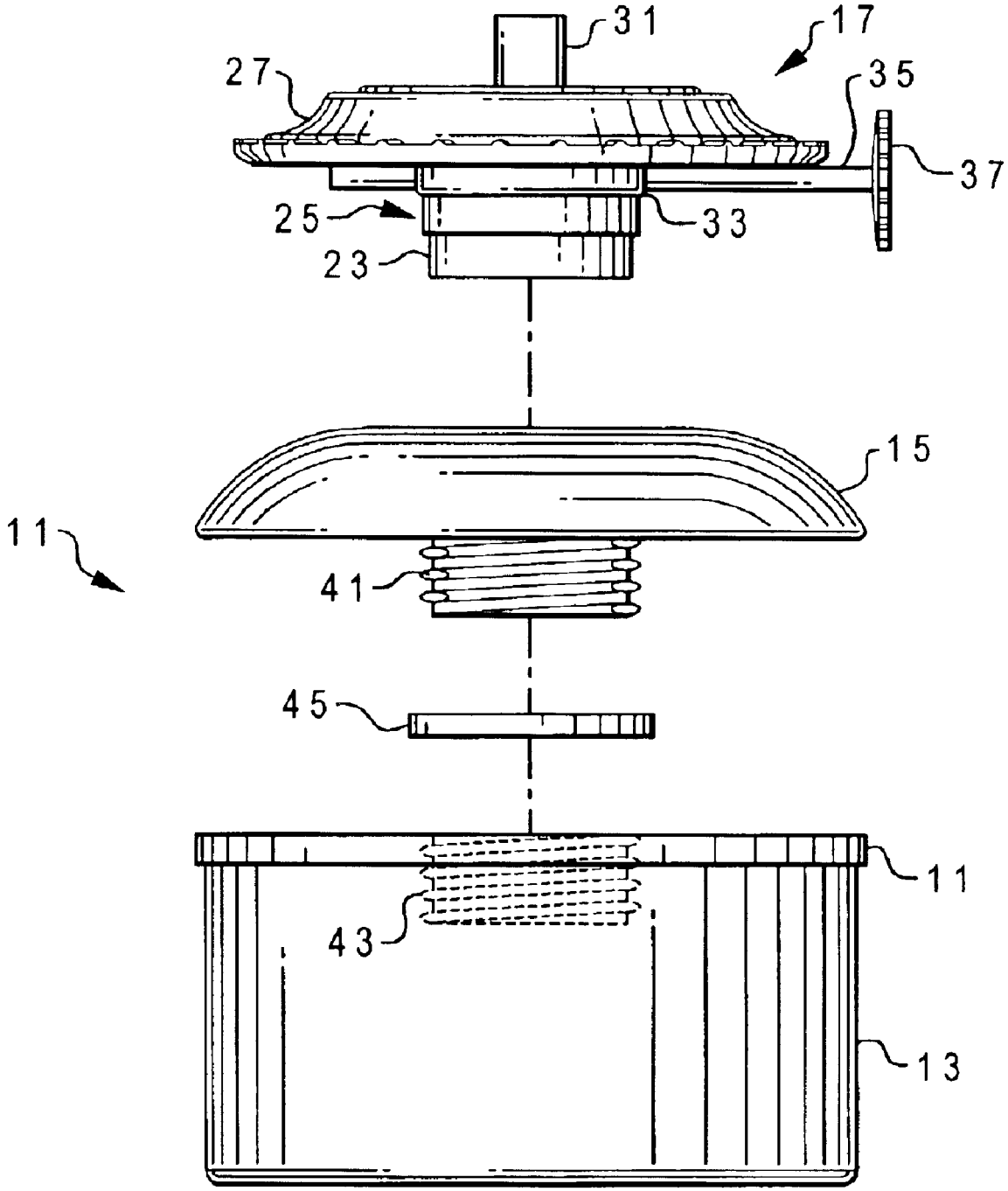
FIG. 8 is an assembly view of the oil burning lamp of FIG. 1.

Referring additionally now to FIG. 8 in the drawings, burner assembly 17 includes a neck portion 23, a wick adjustment means 25 connected to neck portion 23, a heat shield 27 connected to wick adjustment means 25, vent holes 29 through heat shield 27, and a wick support 31 coupled to heat shield 27. Wick adjustment means 25 includes a housing 33, a wick advancement assembly (not shown), an adjustment shaft 35 that passes into housing 33, and an adjustment knob 37 that is connected to adjustment shaft 35. Wick 19 preferably passes through housing 33 and is engaged by wick advancement assembly in a conventional manner, such as by at least one toothed gear, such that when a user turns wick adjustment knob 37, wick 19 is either extended out of fuel reservoir 13 or retraced into fuel reservoir 13, depending upon the direction of rotation of wick adjustment knob 37. Air flow through and around heat shield 27 and vent holes 29 aids in dissipating the heat energy from lamp 11.

In the preferred embodiment, fuel expansion chamber 15 is a hollow saucer shaped reservoir disposed above and in fluid communication with fuel reservoir 13. Fuel expansion chamber 15 includes a threaded neck 41 that extends down into fuel reservoir 13 and is matingly received by an interior threaded neck 43 in fuel reservoir 13. In the preferred embodiment, a conventional seal 45 is disposed between fuel reservoir 13 and fuel expansion chamber 15, so that when threaded neck 41 of fuel expansion chamber 15 is screwed into threaded neck 43 of fuel reservoir 13, a fluid tight seal is formed. Seal 45 is preferably a nylon or rubber O-ring, but may be any other suitable material, treatment, component, or coating. Seal 45 may also be a multi-part seal with components disposed on both neck 41 and neck 43. As explained in more detail below, this configuration prevent fuel leaks and spills in the event of thermal expansion of the fuel, or if lamp 11 is inadvertently knocked over onto its side.

It should be understood that the means for releasably coupling fuel expansion chamber 15 to fuel reservoir 13 may be other than a threaded coupling. For example, fuel expansion chamber 15 may be releasably coupled to fuel reservoir 13 by a conventional twist lock fastener, or a tabbed snap latch. In addition, it should be understood that seal 45 may be integral with either neck 41 or neck 43; and that the sealing of the connection between fuel reservoir 13 and fuel expansion chamber 15 may be accomplished without a separate seal. For example, neck 41 and neck 43 may be configured so as to form a sufficient seal when neck 41 and neck 43 are press-fit, twist-locked, or snap fitted together; or neck 41 and neck 43 may be formed from materials that create a sufficient fluid tight seal when coupled together in a selected fashion.

In the preferred embodiment, neck 43 is the only access port, or opening, into fuel reservoir 13. Fuel reservoir 13 may only be filled with fuel by passing the fuel through neck 43. Also, in the preferred embodiment, burner assembly 17 is permanently coupled to fuel expansion chamber 15. Thus, the only way to fill fuel reservoir 13 with fuel is to unscrew the permanently coupled combination of fuel expansion chamber 15 and burner assembly 17 from fuel reservoir 13. This configuration prevents the refilling of fuel reservoir while lamp 11 is burning, and is an important safety feature.

In operation, fuel expansion chamber 15 and burner assembly 17 are uncoupled from connection to fuel reservoir 13 by loosening threaded neck 41 from threaded neck 43. Fuel, such as kerosene or oil, is then poured into fuel reservoir 13 through neck 43. Fuel expansion chamber 15 and burner assembly 17 are then recoupled to fuel reservoir 13 by tightening threaded neck 41 into threaded neck 43, such that seal 45 forms a fluid tight seal between fuel expansion chamber 15 and fuel reservoir 13. The height of wick 19 above wick guide 31 is then adjusted by rotating adjustment knob 37 in the appropriate direction. Wick 19 will absorb the fuel and wick the fuel up toward the exposed end of wick 19. Wick 19 is then lit by the user. After lighting, wick 19 and the absorbed fuel will burn, thereby producing the desired light and heat. Lamp 11 may be used as a stand alone light source, or lamp 11 may be placed in a decorative lantern to produce a desired ambiance.

As wick 19 and the absorbed fuel burn, heat energy is transferred to burner assembly 17 through wick support 31. Air flow through and around wick support 31, heat shield 27, and vent holes 29 aids in dissipating the heat energy from lamp 11. Heat energy that is not dissipated by wick support 31, heat shield 27, and vent holes 29 is transferred to fuel expansion chamber 15 and to fuel reservoir 13, through burner assembly 17. This heat energy is then transferred to the fuel inside fuel reservoir 13, causing the fuel to undergo thermal expansion. If the fuel thermally expands beyond the capacity fuel reservoir 13, the fuel flows into fuel expansion chamber 15, where the fuel is stored until the fuel is either consumed by the fire, or cools down to a temperature that causes the fuel to contract. As the fuel is either consumed by the fire or cools, it contracts in volume making storage volume available in fuel reservoir 13. As storage volume is made available in fuel reservoir 13, the fuel drains back into fuel reservoir 13 from fuel expansion chamber 15. In this manner, dangerous fuel leaks and spills as result of thermal expansion of fuel is prevented by the present invention.

Fuel expansion chamber 15 also serves as an overflow fuel chamber should lamp 11 or fuel reservoir 13 be inadvertently tilted or knocked over sideways. In the event that lamp 11 is knocked over, fuel expansion chamber 15 provides added storage capacity to receive at least a portion of any fuel that would flow out of fuel reservoir 13. Once lamp 11 is set upright again, the fuel that was temporarily stored in fuel expansion chamber 15 flows back into fuel reservoir 13. This configuration greatly reduces the risk of danger should lamp 11 be knocked over onto its side.

Figure 9:
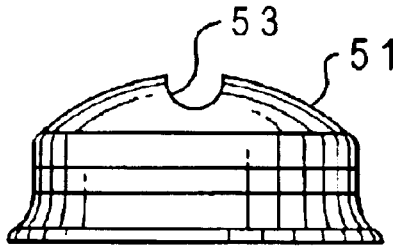
FIG. 9 is a side view of an optional flame shield for the oil burning lamp of FIG. 1.
Figure 10:
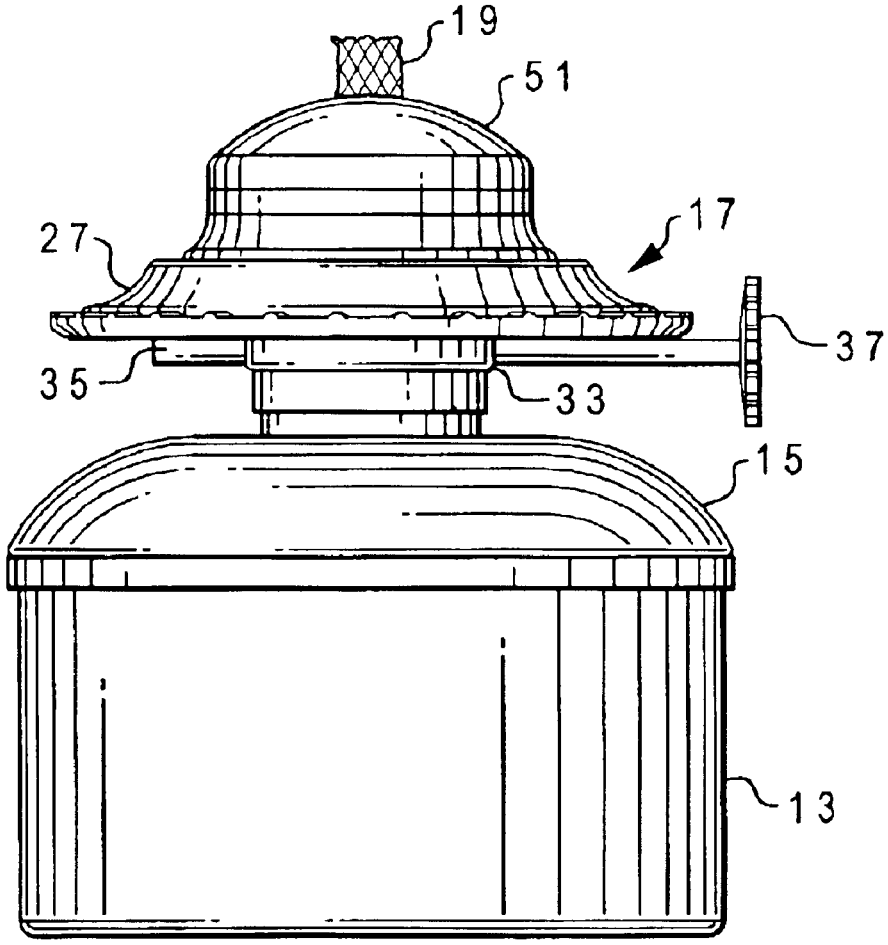
FIG. 10 is an assembled view of the oil burning lamp of FIG. 1 with the flame shield of FIG. 9 installed.

Referring now to FIGS. 9 and 10 in the drawings, an optional dome shaped flame shield 51 is illustrated. Flame shield 51 includes a transverse slot 53 in the top of the dome through which wick 19 extends. It is preferred that flame shield 51 be permanently coupled to burner assembly 17. Flame shield 51 partially covers wick 19 so that wind or other ambient airflow does not fully extinguish the flame produced while wick 19 and the absorbed fuel are burning.

The present invention provides significant advantages. Because fuel undergoing thermal expansion flows into fuel expansion chamber 15, the fuel does not leak or spill. This greatly reduces the chance of fire, injury to the user, and damage to lamp 11 and other property. In addition, because lamp 11 cannot be refilled with fuel while burning, the chance of fire, injury to the user, and damage to lamp 11 and other property is greatly reduced. Furthermore, because fuel expansion chamber 15 also serves as an overflow fuel chamber, if lamp 11 is inadvertently knocked over, the fuel will flow into fuel expansion chamber 15, not out of lamp 11 where the spilled fuel can create a dangerous situation.

It is apparent that an invention with significant advantages has been described and illustrated. Although the present invention is shown in a limited number of forms, it is not limited to just these forms, but is amenable to various changes and modifications without departing from the spirit thereof.

We claim:

1. An oil burning lamp comprising:

a fuel reservoir for storing fuel, the fuel reservoir having a predetermined diameter;

a fuel expansion chamber releasably coupled to and in fluid communication with the fuel reservoir, the fuel expansion chamber being configured to receive fuel that overflows from the fuel reservoir;

said fuel expansion chamber having a radially-enlarged lower portion and a radially-reduced upper portion, and an arcuate outer surface extending there between;

wherein said radially-enlarged lower portion has a diameter generally corresponding to the predetermined diameter;

a burner assembly non-releasably coupled to the fuel expansion chamber, wherein the fuel expansion chamber and burner assembly must be removed to put fuel into the fuel reservoir;

a wick adjustment means; and a wick in fluid communication with the fuel reservoir.

2. The oil burning lamp according to claim 1, wherein the fuel expansion chamber is releasably coupled to the fuel reservoir by a threaded coupling.

3. The oil burning lamp according to claim 2, wherein the threaded coupling extends down into the fuel reservoir.

4. The oil burning lamp according to claim 1, wherein the fuel expansion chamber is releasably coupled to the fuel reservoir by a twist lock fastener.

5. The oil burning lamp according to claim 1, wherein the fuel expansion chamber is releasably coupled to the fuel reservoir by a tabbed snap latch coupling.

6. The oil burning lamp according to claim 1, wherein the fuel reservoir has only one access port, the access port being in fluid communication with the fuel expansion chamber.

7. The oil burning lamp according to claim 1, wherein the wick adjustably passes through the fuel reservoir, the fuel expansion chamber, the wick adjustment means, and the burner assembly.

8. The oil burning lamp according to claim 1, further comprising:

a seal disposed between the fuel reservoir and the fuel expansion chamber for providing a fluid tight seal between fuel reservoir and the fuel expansion chamber.

9. The oil burning lamp according to claim 8, wherein the seal is a rubber O-ring.

10. The oil burning lamp according to claim 8, wherein the seal is a nylon O-ring.

11. The oil burning lamp according to claim 8, wherein the seal is integral with the fuel expansion chamber.

12. The oil burning lamp according to claim 8, wherein the seal is integral with the fuel reservoir.

13. The oil burning lamp according to claim 8, wherein the seal is a multi-part seal with components on both the fuel expansion chamber and the fuel reservoir.

14. The oil burning lamp according to claim 8, wherein the seal is formed by selectively treating the coupling between the fuel reservoir and the fuel expansion chamber.

15. The oil burning lamp according to claim 8, wherein the seal is formed by selectively coating the coupling between the fuel reservoir and the fuel expansion chamber.

16. The oil burning lamp according to claim 1, wherein the burner assembly comprises:

a heat shield having a diameter generally corresponding to the predetermined diameter;

a plurality of vent holes passing through the heat shield; and a wick support for supporting the wick.

17. The oil burning lamp according to claim 1, further comprising:

a flame shield disposed above the burner assembly for limiting airflow around the wick.

18. The oil burning lamp according to claim 1, wherein the overflow fuel received by the fuel expansion chamber is a result of thermal expansion of the fuel.

19. The oil burning lamp according to claim 1, wherein the overflow fuel received by the fuel expansion chamber is a result of sideways tilting of the fuel reservoir.

* * * * *